US006588615B1

(12) United States Patent
Pitassi

(10) Patent No.: US 6,588,615 B1
(45) Date of Patent: Jul. 8, 2003

(54) CONTAINER CLOSURE SYSTEM HAVING A CAP REMOVABLE WITH LESS THAN A 45° TWIST

(75) Inventor: James L. Pitassi, Pittsburgh, PA (US)

(73) Assignee: SmithKline Beecham Corporation, Philadelphia, PA (US)

( * ) Notice: Subject to any disclaimer, the term of this patent is extended or adjusted under 35 U.S.C. 154(b) by 0 days.

(21) Appl. No.: 09/661,385

(22) Filed: Sep. 13, 2000

Related U.S. Application Data

(60) Provisional application No. 60/153,680, filed on Sep. 14, 1999.

(51) Int. Cl.[7] ..... B65D 41/47

(52) U.S. Cl. ..... 215/318; 215/295; 215/321

(58) Field of Search ..... 215/338, 318, 215/321, 295, 43, 45; 220/293, 786, 784, 788

(56) References Cited

U.S. PATENT DOCUMENTS

| | | | | |
|---|---|---|---|---|
| 785,000 | A | | 3/1905 | Hicks |
| 1,459,589 | A | | 6/1923 | Hoffman |
| 2,476,155 | A | * | 7/1949 | McKelvy |
| 3,351,227 | A | | 11/1967 | Collie |
| 3,372,834 | A | * | 3/1968 | Ayotte et al. ..... 220/780 |
| 3,464,582 | A | | 9/1969 | Greitzer et al. |
| 3,468,447 | A | | 9/1969 | Smalley |
| 3,470,930 | A | | 10/1969 | Jurczenia |
| 3,904,063 | A | | 9/1975 | Hauser |
| 4,257,526 | A | | 3/1981 | Weits et al. |
| 4,844,269 | A | * | 7/1989 | Lucas |
| 4,858,777 | A | * | 8/1989 | Morel ..... 215/295 |
| 4,967,921 | A | | 11/1990 | Pré et al. |
| 5,552,117 | A | * | 9/1996 | Burns ..... 215/295 |
| 5,715,960 | A | * | 2/1998 | Seymour ..... 215/295 |

FOREIGN PATENT DOCUMENTS

GB 2 063 226 A 6/1981

OTHER PUBLICATIONS

PCT International Search Report dated Dec. 3, 2000.

* cited by examiner

*Primary Examiner*—Robin Hylton
(74) *Attorney, Agent, or Firm*—Finnegan, Henderson, Farabow, Garrett & Dunner, L.L.P.

(57) ABSTRACT

A container closure system enabling persons with weakened hands to open or close a container easily. A cap has a skirt. Internal surfaces of the skirt include substantially coplanar rim-engaging members. The container has a neck portion terminating in a peripheral rim. Cap-engaging portions on the peripheral rim engage with the rim-engaging members on the skirt. The rim-engaging members can be ridges or grooves. A slight twist of he cap of only approximately 5°–20° disengages the rim-engaging member and the cap-engaging portions, releasing the cap to the open position.

8 Claims, 4 Drawing Sheets

CONTAINER CLOSURE SYSTEM HAVING A CAP REMOVABLE WITH LESS THAN A 45° TWIST

This application claims the benefit of provision application No. 60/153,680 filed Sep. 14, 1999.

BACKGROUND OF THE INVENTION

1. Field of the Invention

The present invention relates to a container closure system having a simple structure that facilitates closure and removal of a cap on a container. More specifically, the present invention is directed to a closure mechanism for containers having a neck portion onto which a cap is "pressed" or "snapped" to a closed position over an opening in the top of the container. These types of containers and caps are used to store a multitude of products, and are especially prevalent in the packaging of a wide variety of over-the-counter pharmaceuticals.

2. Description of the Prior Art

Several types of "press-on" or "snap-on" container closures are presently used for the packaging of products. A common feature of these types of container closures is that the cap and the container neck have engaging cams, ribs or threads which allow the cap to be "snapped" or "pressed" onto the container to a closed position over an opening in the top of the container.

The removal of the cap in these types of container closures occurs in a variety of ways. A common way to remove a cap of this construction is to push or pull a grooved cap back off of the engaging rim of a container. This cap structure and means of removal are commonly employed in the construction of container closures for aspirin bottles. Another means for removing the cap involves pushing on the sides of the cap to deform the shape of the cap slightly so that ribs or cams on the cap disengage from those on the container, thus releasing the cap from the container. Another commonly employed means for removing the cap involves twisting the cap about a vertical axis with respect to the container to release engaged ribs or threads. Generally, these twist-off systems require the user to push the cap downward while twisting to disengage a the threads or ribs on the cap from those on the container. In systems that do not require the cap to be pushed downward during the twisting motion, the shape of the container neck relative to the cap often requires that a relatively large twisting force be applied before the engaged cams, ribs, or threads will disengage to release the cap from the container.

Each of these means for removing the cap from the container requires the user to apply a relatively large force to overcome the engaged relationship of the cams, ribs, or threads on the cap and container or to apply a dual set of forces, such as in the combined push-and-twist removal system. Consequently, such container closures often pose difficulties for persons with little hand strength, such as those suffering from arthritis.

It is an object of the present invention, therefore, to provide a "snap-on" container closure that is easier to open than previous container closures. The proposed container closure of the invention is simple in use and construction and alleviates some of the adverse characteristics of present container closure systems that are complex or difficult to open, especially for those suffering from arthritis and the like, as discussed above.

It is a further object of the invention to provide a container closure that accomplishes the goals set forth above while additionally being of simple construction that allows for ease in manufacture.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention is a container closure system. Such a container has a generally oval-shaped opening in one end with the opening having a major axis, a minor axis, and an outer peripheral rim. A cap has a top wall and a skirt depending from the top wall. The skirt has an inner surface of substantially rectangular cross-section, and defines an interior surface of the cap. The interior surface includes a plurality of rim-engaging members. The peripheral outer rim includes cap-engaging portions at the major and minor axes of the rim. The rim-engaging members have their longitudinal axis parallel to the rim. The rim and the plurality of rim-engaging members are in an engaged relationship when the cap is in a closed position over the opening in the container, and the rim and the rim-engaging members are in a disengaged relationship when the cap is twisted less than 45° with respect to the vertical axis of the container to release the cap from the container.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENT

Reference will now be made in detail to the present preferred embodiments of the invention, examples of which are illustrated in FIGS. 1–6. Wherever possible, the same reference numbers will be used throughout the drawings to refer to the same or like parts.

In accordance with the present invention, a container closure system of the present invention is illustrated in FIGS. 1–6. In the embodiments shown, container closure system 1 comprises two principal components, a cap 2 and a container 3.

Figure 3:
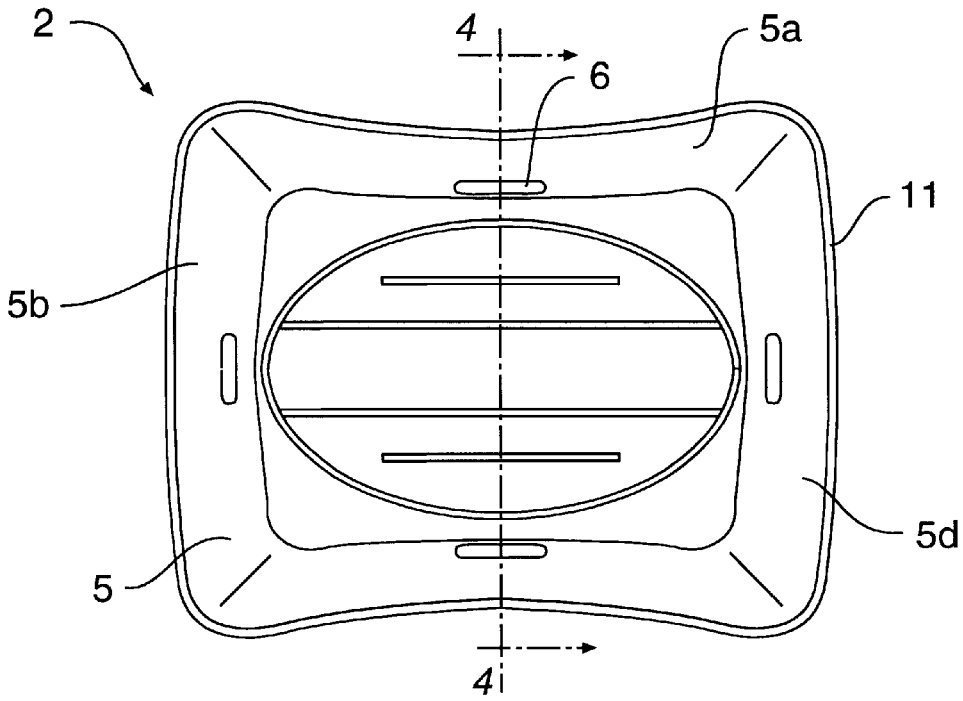
FIG. 3 is a bottom view of one embodiment of the cap.
Figure 4:
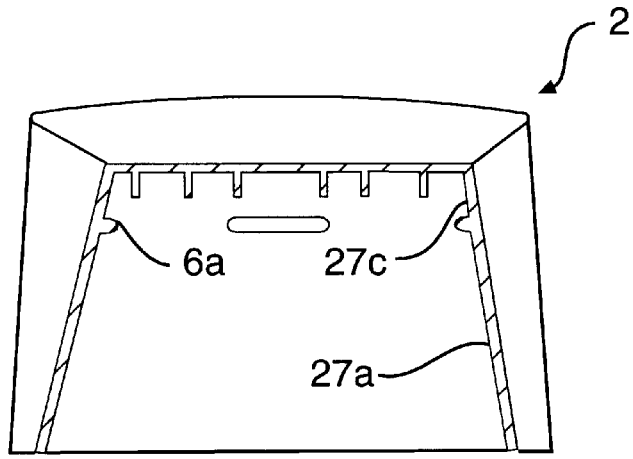
FIG. 4 is a sectional view of the cap of FIG. 3 taken through line 4—4.
Figure 5:
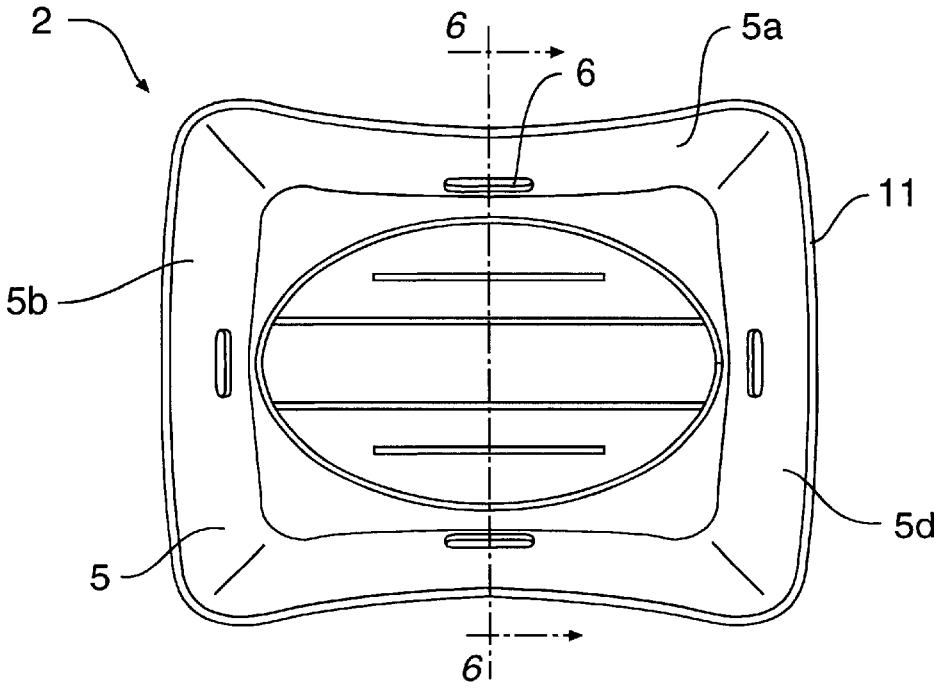
FIG. 5 is a bottom view of a second embodiment of the cap.
Figure 6:
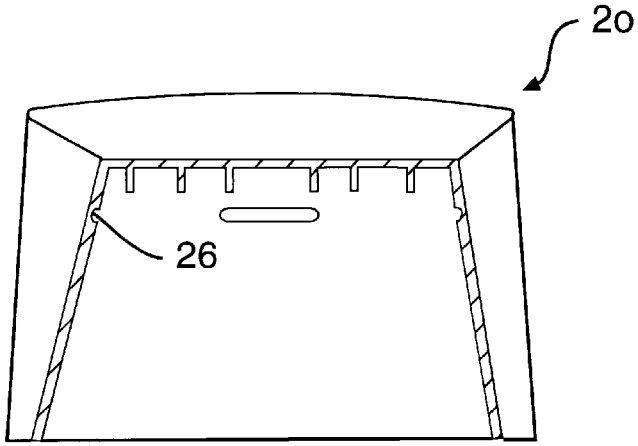
FIG. 6 is a sectional view of the cap of FIG. 5 taken through line 6—6.

In accordance with the invention, the cap of the container closure system has a top wall and a skirt depending from the top wall that engages with the container of the closure system. In the illustrated embodiments, cap 2 comprises a top wall 15 and a skirt 4 depending from top wall 15. Skirt 4 of cap 2 terminates at its lower end in a substantially rectangular edge 11. Skirt 4 also has an inner surface 5, as clearly shown in FIGS. 3 and 5. Inner surface 5 defines the interior surface of cap 2. In a horizontal plane, inner surface 5 of skirt 4 is substantially rectangular in cross-section. Inner surface 5 may comprise four inner surface portions 5*a*–5*d*, each forming, substantially, the legs of a rectangle when viewed in cross-section. In a preferred embodiment of the invention, the inner surface portions that form the longer legs of the rectangle, for example inner surface portions 5*a* and 5*c*, slightly curve or bow inward toward their respective centers. FIGS. 5 and 6 show a cap 20 having a construction substantially similar to cap 2 except for alterations to the inner surface portions to be described In accordance with the invention, a first plurality of rim-engaging members are provided on the interior surface of the cap for securing the cap into place on the container. According to one embodiment of the present invention, as illustrated in FIGS. 3 and 4, disposed on the interior surface of cap 2 is a plurality of relatively small ridges 6*a*–*d*. As most clearly illustrated in FIG. 4, ridges 6*a*–*d* protrude slightly from the respective inner surface portions 5*a*–5*d* on which they are disposed toward a center region enclosed by skirt 4. In a preferred form of the invention, there are four ridges, with each of the four ridges disposed substantially near the center of each inner surface portion 5*a*–5*d* of skirt 4. Ridges 6*a*–*d* are generally coplanar and are disposed along inner surface 5 in a substantially horizontal plane. Ridges 6*a*–*d* preferably have respective lengths of approximately one-sixth to one-tenth the length of the inner surface portion on which they are disposed. Preferably, ridges 6*a* and 6*c* disposed on longer inner surface portions 5*a* and 5*c* have longer lengths than those disposed on shorter inner surface portions 5*b* and 5*d*. In the embodiment of the invention shown in FIGS. 3 and 4, ridges 6*a*–*d* that are disposed on opposing inner surface portions, for example, ridges 6*a* and 6*c* on inner surface portions 5*a* and 5*c*, are equal in length, thereby facilitating manufacture of cap 2.

FIGS. 5 and 6 show a second embodiment of a cap 20 according to the present invention. As already mentioned, cap 20 has the same general features with respect to skirt 4, top wall 15, and terminating edge 11 as discussed with reference to cap 2. Inner surface 27 forming the interior surface of cap 20 also is substantially similar to inner surface 5 of cap 2, with the exception of the form of the rim-engaging members disposed thereon. That is, cap 20 includes rim-engaging members in the form of relatively small grooves 26*a*–*d*. Grooves 26*a*–*d*, as most clearly illustrated in FIG. 6, create slight indentations at their respective locations on inner surface portions 27*a*–27*d*. As with ridges 6*a*–*d*, preferably four grooves 26*a*–*d* are disposed substantially near the center of each of the inner surface portions 27*a*–27*d* and in generally the same substantially horizontal plane. Grooves 26*a*–*d* preferably have the same respective lengths, relative to each other and to the inner surface portions on which they are disposed, as described above with reference to ridges 6*a*–*d*.

In accordance with the present invention, the container closure system further includes a container having a generally oval-shaped opening in one end of the container. The opening has a major axis, a minor axis, and an outer peripheral rim adapted to engage the cap of the container closure system. The outer peripheral rim includes cap-engaging portions at the major and minor axes. As illustrated in the embodiments shown in FIGS. 1 and 2, container closure system 1 includes container 3 comprising an oval-shaped opening 7 through which products held by container 3 are dispensed. Oval-shaped opening 7 is surrounded by peripheral rim 8.

Figure 1:
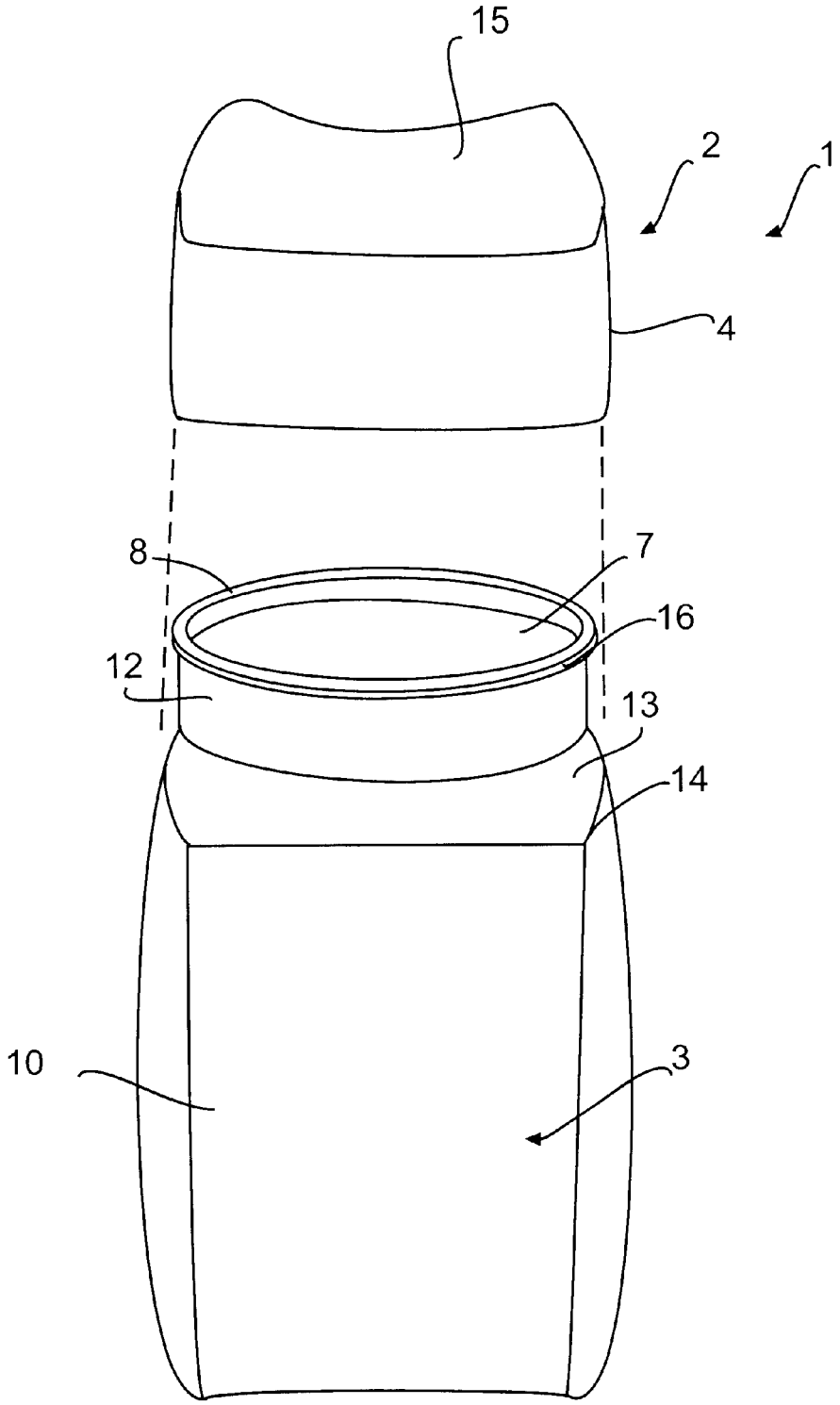
FIG. 1 is a perspective view of the container body and cap of one preferred embodiment of the invention.

In a first embodiment of the present invention as shown in FIG. 1, cap-engaging portions are formed on peripheral rim 8 by a small lip or edge 16 that extends around outer peripheral rim 8. These portions of edge 16 are configured to engage with ridges 6*a*–*d* on cap 2 when cap 2 is in a closed position.

Figure 2:
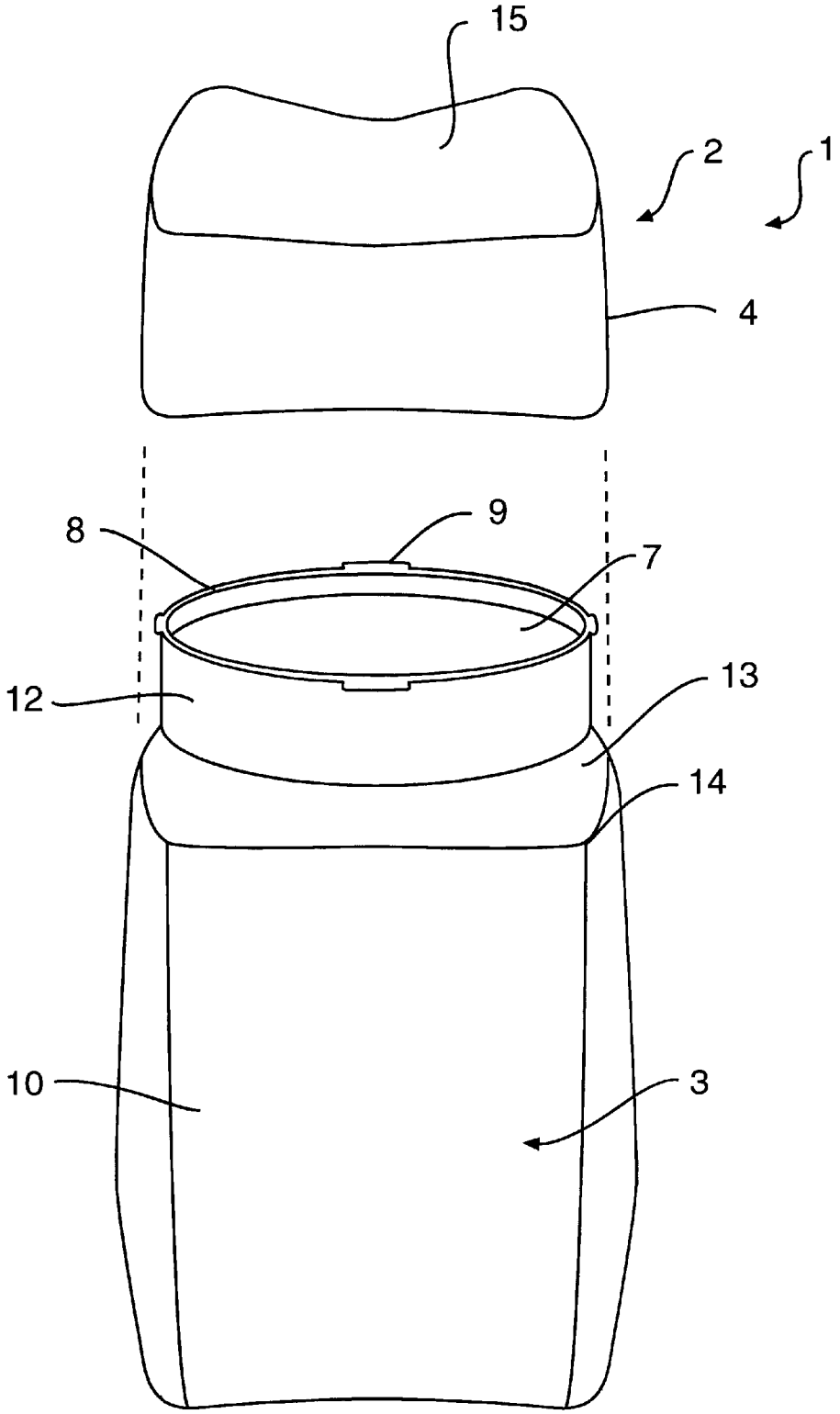
FIG. 2 is a perspective view of the container body of a second preferred embodiment of the invention.

In a second illustrated embodiment shown in FIG. 2, cap-engaging portions include a plurality of small ribs 9*a*–*d* disposed on outer peripheral rim 8 in positions that correspond to and engage with either ridges 6*a*–*d* on cap 2 or grooves 26*a*–*d* on cap 20 when either of these caps is in a closed position over opening 7. Specifically, it is contemplated to dispose ribs 9*a*–*d* at opposite axes of opening 7 and peripheral rim 8. Preferably, ribs 9*a*–*d* are uniform in length and approximately equal to the longer of the lengths of ridges 6*a*–*d*, or grooves 26*a*–*d*, and have their longitudinal axes parallel to peripheral rim 8.

According to both of the respective embodiments shown in FIGS. 1 and 2, container 3 further includes main container body 10 and neck 12. Neck 12 extends from a top end of container 3 and terminates in outer peripheral rim 8 surrounding oval-shaped opening 7. A sloped surface 13 connects main container body 10 to the bottom end of neck 12. In the form of the invention shown in FIGS. 1 and 2, main container body 10 has a substantially rectangular cross-section in a horizontal plane of intersection and its top peripheral edge 14, from which sloped surface 13 extends, preferably has dimensions equal to edge 11 of skirt 4. Additionally, neck 12 preferably has an oval cross-section in a horizontal plane of intersection.

According to the invention, the rim of the container and the plurality of rim-engaging members are in an engaged relationship when the cap is in a closed position over the opening in the container. As the cap is twisted less than approximately 45° with respect to the vertical axis of the container, the rim and the rim-engaging members disengage to release the cap from the container.

In use, the embodiments of the container closure system 1 illustrated in FIG. 1–4 operate in the following manner. Cap 2 is secured to a closed position over opening 7 of container 3 by substantially aligning terminating edge 11 of skirt 4 with top peripheral edge 14 of main container body 10 and pressing downward, thereby "snapping" or "pressing" ridges 6*a*–*d* past either ribs 9*a*–*d* or edge 16. In this closed position, ridges 6*a*–*d* are in an engaged position with either edge 16, as shown in FIG. 1, or ribs 9*a*–*d*, as shown in FIG. 2. While in the engaged position, ridges 6*a*–*d* are disposed below either edge 16 or ribs 9*a*–*d*, respectively. Thus, in the closed position, ridges 6*a*–*d* and edge 16, or ridges 6*a*–*d* and ribs 9*a*–*d*, will remain in an engaged relationship to maintain cap 2 in its closed position while cap 2, container 3 and its contents are lifted solely by virtue of gripping cap 2. While in this engaged relationship, ridges 6*a–d* and edge 16, or ridges 6*a–d* and ribs 9*a–d*, are capable of withstanding a force equal to at least the weight of container 3 plus products contained therein. Preferably, when ridges 6*a–d* and edge 16, or ridges 6*a–d* and ribs 9*a–d*, are in an engaged relationship, they should be capable of withstanding a force greater than the weight of container 3 plus its contents, such that cap 2 is not easily pulled off of container 3.

From its closed position, cap 2 can be manipulated to an open position by simply twisting cap 2 about a vertical axis relative to container 3. In the preferred embodiments, cap 2 need only be twisted less than 45°, preferably between approximately 5° to 20°, relative to container 3 to release cap 2 from container 3. As shown in FIG. 1, ridges 6*a–d* slide with respect to edge 16 and, due to the relative geometric configuration between the interior surface of cap 2 and peripheral rim 8, disengage from edge 16. In particular, the geometric relationship between the ridges disposed on shorter inner surface portions 5*b* and 5*d* and edge 16 assist in facilitating disengagement. Thus, cap 2 is released from container 3. Alternatively, as shown in FIG. 2, by twisting cap 2, ridges 6*a–d* slide with respect to ribs 9*a–d*, thereby disengaging from ribs 9*a–d* to release cap 2 from its closed position on container 3 so that it may be removed.

The engaging and disengaging of cap 20 occurs in generally the same manner as cap 2. Cap 20, however, is especially suitable for use in conjunction with the form of container 3 shown in FIG. 2. Thus, as with cap 2, to securely close container 3 requires substantially aligning terminating edge 11 of skirt 4 with top peripheral edge 14 of main container body 10 and pressing downward, thereby "snapping" or "pressing" ribs 9*a–d* into grooves 26*a–d*. In this closed position, grooves 26*a–d* are in an engaged position with ribs 9*a–d*. While in the engaged position, grooves 26*a–d* essentially receive ribs 9*a–d* such that the peripheral surface of inner portions 27*a–27d*, respectively, that define grooves 26*a–d* substantially contact the outer surface defining ribs 9*a–d*. Thus, in the closed position, grooves 26*a–d* and ribs 9*a–d* will remain in an engaged relationship to maintain cap 20 in its closed position while cap 20, container 3 and its contents are lifted solely by virtue of gripping cap 20. While in this engaged relationship, the contact between grooves 26*a–d* and ribs 9*a–d* can withstand a force equal to at least the weight of container 3 plus products contained therein. Preferably, when grooves 26*a–d* and ribs 9*a–d* are in an engaged relationship, they should be capable of withstanding a force greater than the weight of container 3 plus its contents, such that cap 2 is not easily pulled off of container 3.

From its closed position, as with cap 2, cap 20 can be manipulated to an open position by simply twisting cap 20 about a vertical axis relative to container 3. In the preferred embodiments, cap 20 need only be twisted less than 45°, preferably between approximately 5 to 20°, relative to container 3 to release cap 20 from container 3. As shown in FIG. 2, by twisting cap 20, ribs 9 and grooves 26 slide with respect to one another, thereby disengaging from each other to release cap 20 from its closed position on container so that it may be removed.

Generally facilitating the removal of either of caps 2 or 20 from container 3 is the relative geometry between oval-shaped opening 7 and outer peripheral rim 8 and the substantially rectangular cross-sectional configuration of skirt 4. The major axis diameter of peripheral rim 8 should have a length such that after cap 2 (or cap 20) is twisted slightly about the vertical axis, the outer portion of oval-shaped peripheral rim contacts longer inner surface portions 5*a* and 5*c* (or 27*a* and 27*c*) of skirt 4 to substantially prevent any further twisting of cap 2 (or cap 20). Any further twisting of cap 2 (or cap 20) that occurs after the outer portion of peripheral rim 8 comes into contact with the inner surface portions causes skirt 4 to ride up along neck 12, thereby lifting cap 2 (or cap 20) away from container 3. The relative geometrical configurations between peripheral rim 8 and skirt 4 should be such that cap 2 (or cap 20) need only be twisted less than 45°, and preferably between approximately 5 to 20°, to disengage ridges 6*a–d* (or grooves 26) from cap-engaging portions on rim 8 and cause the outer portion of peripheral rim 8 to contact inner surface portions 5*a* and 5*c* (or 27*a* and 27*c*).

A further aspect according to an embodiment of the present invention that facilitates removal of cap 2 (or cap 20) is sloped surface 13. Upon twisting cap 2 (or cap 20), edge 11 of skirt 4 travels along sloped surface 13 tending to cause edge 11 to smoothly lift in a direction away from top peripheral edge 14 of container main body 10 as cap 2 (or cap 20) is manipulated to its open position.

According to the embodiments of the present invention, the various parts of container closure system 1 preferably are made of materials having relatively low coefficients of friction in order to permit smooth and non-damaging motions between the structural parts, for example, the engaging and disengaging of rim-engaging members and cap-engaging portions, the riding of inner surface 5 or 27 along peripheral rim 8 and neck 12, and the sliding between edge 11 and sloped surface 13, that are necessary for the operation of container closure system 1. A thermoplastic polymer represents one example of a material that would permit these types of motions without resulting in damage to the various parts, but the use of other materials is envisioned as well and considered to be within the scope of this invention.

It will be apparent to those skilled in the art from consideration of the specification and practice of the invention disclosed herein that various modifications and variations can be made in the container closure system of the present invention. An example of such a modification would be a change in the relative geometrical configurations of the cross-sections of skirt 4 and peripheral rim 8 and opening 7 in such a manner so as to continue to effect the advantages of the container closure set forth herein. Furthermore, although the embodiments of the invention shown in the Figures include four rim-engaging members disposed on the cap, a different number of rim-engaging members may be utilized and is considered within the scope of the invention. Similarly, the number of ribs disposed on the outer peripheral rim may vary accordingly.

Therefore, the invention in its broader aspects is not limited to the specific details and illustrative examples shown and described in the specification. It is intended that departures may be made from such details without departing from the true spirit or scope of the general inventive concept as defined by the following claims and their equivalents.

What is claimed is:

1. A container closure system, comprising:

a container having a substantially oval-shaped opening in one end thereof, said opening having a major axis, a minor axis, and an outer peripheral rim, a cap having a top wall and a skirt depending from said top wall, said skirt having an inner surface of substantially rectangular cross-section, said skirt defining an interior surface of said cap, said interior surface including a plurality of rim-engaging members;

said outer peripheral rim including cap-engaging portions at the major and minor axes of said outer peripheral rim, said plurality of rim-engaging members having their longitudinal axis parallel to said rim;

said rim and said plurality of rim-engaging members being in an engaged relationship when said cap is in a closed position over the opening in the container, and wherein said rim and said plurality of rim-engaging members will be in a disengaged relationship when said cap is twisted less than 45° with respect to the vertical axis of said container, thereby releasing said cap from said container;

wherein said rim-engaging members comprise four grooves in said interior surface of said cap, said grooves being located opposite the major and minor axes of said opening in said cap, said grooves being disposed to engage portions of said rim at the major and minor axes of said opening when said container is closed.

2. The container closure system of claim 1, wherein said cap-engaging portions comprise four ribs located on the major and minor axes of said outer peripheral rim of said opening.

3. The container closure system of claim 1, wherein said cap is twisted with respect to the vertical axis of said container.

4. The container closure system of claim 1, wherein said container comprises a main body portion and a neck portion attached to an upper end of the main body portion, the neck portion terminating to form the peripheral rim.

5. The container closure system of claim 4, further comprising a sloped surface connecting the neck portion to the main body portion.

6. The container closure system of claim 5, wherein upon twisting the cap to the open position, an edge of the skirt contacts the sloped surface causing the cap to move in a direction away from the container main body.

7. The container closure system of claim 6, wherein the main body has a substantially rectangular cross-section in a horizontal plane and the neck portion has a substantially oval cross-section in a horizontal plane.

8. The container closure system of claim 1, wherein said cap is twisted with respect to said container approximately 5–20 degrees to release said cap from the container.

* * * * *